US005335643A

United States Patent [19]

Abate et al.

[11] Patent Number: 5,335,643

[45] Date of Patent: Aug. 9, 1994

[54] ELECTRONIC INJECTION FUEL DELIVERY CONTROL SYSTEM

[75] Inventors: Maurizio Abate, Orbassano; Claudio Carnevale, Nole Canavese; Pietro Nenzioni, Bologna; Aldo Perotto, Meana Di Susa, all of Italy

[73] Assignee: Weber S.r.l., Turin, Italy

[21] Appl. No.: 988,237

[22] Filed: Dec. 9, 1992

[30] Foreign Application Priority Data

Dec. 13, 1991 [IT] Italy ..... 000976 A/91

[51] Int. Cl.[5] ..... F02D 41/14

[52] U.S. Cl. ..... 123/679; 123/684

[58] Field of Search ..... 123/672, 673, 674, 679, 123/680, 681, 682, 683, 684

[56] References Cited

U.S. PATENT DOCUMENTS

| | | | |
|---|---|---|---|
| 4,282,842 | 8/1981 | Sasayama | 123/684 |
| 4,348,727 | 9/1982 | Kobayashi et al. | 123/681 X |
| 4,463,594 | 8/1984 | Raff et al. | 73/23 |
| 4,748,957 | 6/1988 | Menard et al. | 123/672 X |
| 4,765,305 | 8/1988 | Hibino et al. | 123/684 |
| 4,766,871 | 8/1988 | Lefevre et al. | 123/684 |

FOREIGN PATENT DOCUMENTS

| | | |
|---|---|---|
| 0236207 | 9/1987 | European Pat. Off. . |
| WO89/09330 | 10/1989 | World Int. Prop. O. . |

*Primary Examiner*—Willis R. Wolfe

*Attorney, Agent, or Firm*—Baker & Daniels

[57] ABSTRACT

A system for controlling the fuel delivery of an electronic injection system, whereby a processing unit determines the amount of fuel to be injected for achieving a substantially correct stoichiometric air/fuel ratio; which value is subsequently corrected by a coefficient calculated by integrating a signal comprising a signal supplied by a sensor located in the exhaust manifold of the engine and presenting a transfer function comprising a nonlinear characteristic and a delay seriously affecting system response. The system also comprises a processing unit for simulating the transfer function of the engine-sensor system and generating a signal simulating the signal actually produced by the sensor but minus the delay introduced by the sensor and the system; which signal is used for producing a correction signal which is added to the signal generated by the sensor for compensating the delay and so improving the dynamic response of the system as a whole.

18 Claims, 3 Drawing Sheets

ELECTRONIC INJECTION FUEL DELIVERY CONTROL SYSTEM

BACKGROUND OF THE INVENTION

The present invention relates to a system for controlling the fuel delivery of an electronic injection system.

Known electronic injection systems present an electronic control system with a processing unit for receiving and processing signals proportional to engine speed and air pressure and temperature in the intake manifold, and accordingly supplying an output value ($Q_b$) indicating the amount of fuel to be injected for achieving a substantially correct stoichiometric air/fuel ratio.

The output value ($Q_b$), which is normally determined by means of memorized tables, is modified by monitoring the composition of the exhaust gas with the aid of a sensor inside the exhaust manifold, which supplies a signal ranging from 0 to 1 V, depending on whether the air/fuel mixture contains more or less fuel as compared with the required stoichiometric ratio.

The signal from the sensor is processed with the aid of a proportional-integral controller for obtaining a correction factor ($K_{02}$) by which the previously calculated fuel quantity value ($Q_b$) is modified to give the correct fuel quantity ($Q_{bc}$). This therefore provides for closed-loop control of the amount of fuel injected, by virtue of feeding back the signal supplied by the sensor.

The exhaust sensor presents a transfer function simulatable by a nonlinear characteristic and a time delay, which is substantially the time interval between the instant in which the air/fuel mixture departs from the stoichiometric value and the instant in which the sensor switches subsequent to detecting the variation.

To this is added a further delay, between the instant in which the fuel is injected and the instant in which departure from the stoichiometric ratio is detected, due to the time taken to travel along the intake manifold, undergo combustion, and travel along the exhaust manifold.

The above delays seriously impair the response and dynamic performance of the system as a whole, by virtue of the exhaust sensor signal failing to correspond with the actual composition of the air/fuel mixture.

Particularly under transient operating conditions of the engine (corresponding, for example, to sharp variations in supply pressure), the correction factor ($K_{02}$) fails to provide for adequately correcting the fuel quantity determined by the processing unit, thus resulting in the air/fuel ratio departing substantially from the stoichiometric ratio.

SUMMARY OF THE INVENTION

It is an object of the present invention to provide a system designed to overcome the drawbacks typically associated with known injection systems, by ensuring the air/fuel ratio corresponds at all times with the stoichiometric ratio under all operating conditions.

According to the present invention, there is provided an internal combustion engine electronic fuel injection system, characterized by the fact that it comprises:

first means for determining a theoretical fuel quantity ($Q_b$) as a function of information signals (P, T, n);

second means for calculating a parameter ($K_{02}$) for correcting said theoretical quantity ($Q_b$) as a function of a signal (A) generated by a sensor inside the exhaust manifold of said engine;

said sensor presenting a transfer function comprising at least a nonlinear characteristic and a time delay;

third means for calculating a correct fuel quantity ($Q_{bc}$) as a function of said parameter ($K_{02}$);

predicting means receiving at least the value of said parameter ($K_{02}$) and generating a correction signal (D);

said predicting means at least comprising means for generating a prediction signal (B) simulating said signal (A) generated by said sensor and minus said delay; and adding means for adding said prediction signal to said signal generated by said sensor.

BRIEF DESCRIPTION OF THE DRAWINGS

The present invention will be described with reference to the accompanying drawings, in which.

DETAILED DESCRIPTION OF THE INVENTION

Figure 1:
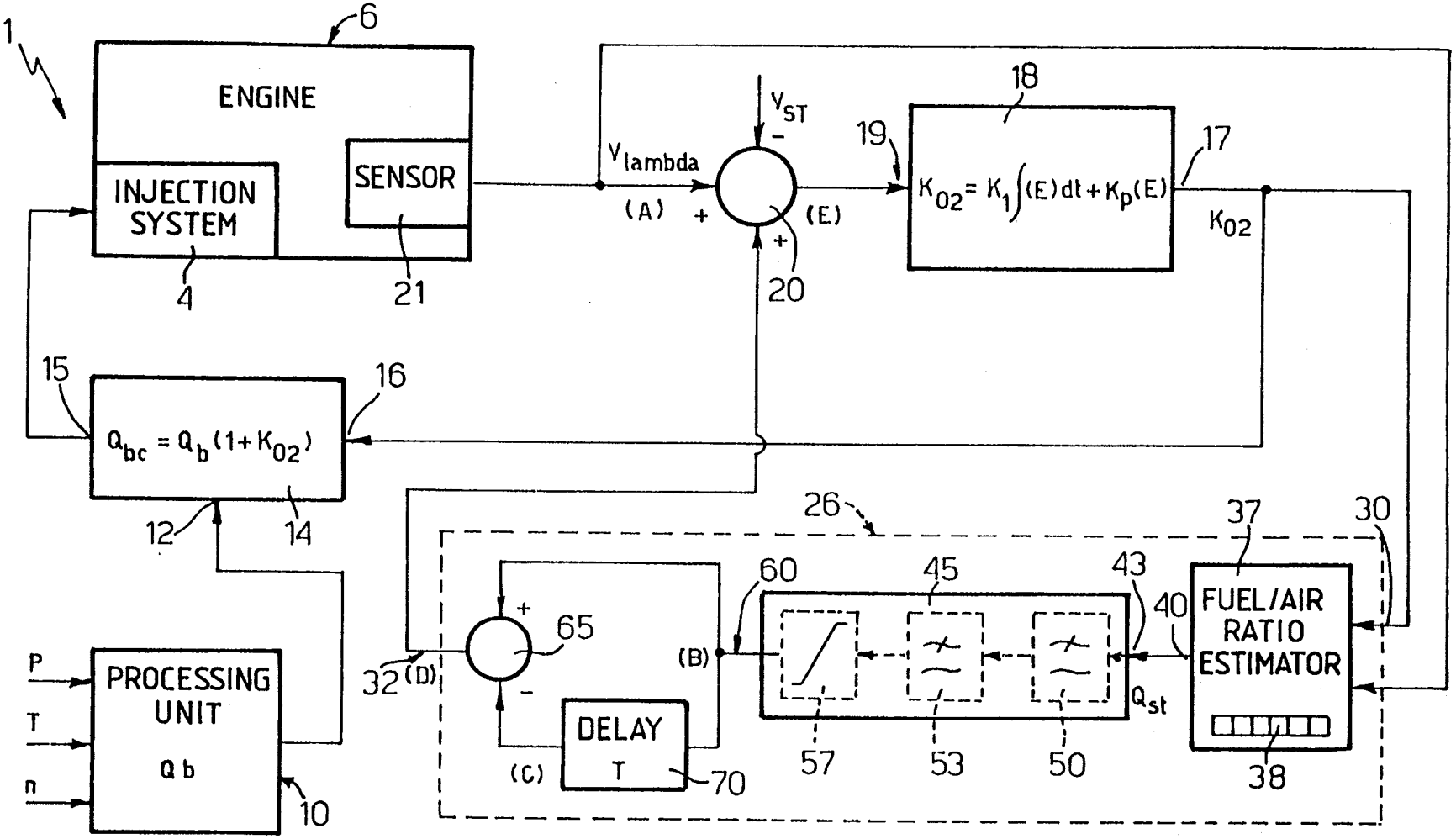
FIG. 1 shows a schematic view of the control system according to the present invention.

Number 1 in FIG. 1 indicates a system for controlling the fuel delivery of an electronic injection system 4 of a petrol engine 6.

System 1 comprises a processing unit 10 supplied with three input signals proportional to air intake pressure (P), air intake temperature (T), and engine speed (n). The output of unit 10 is connected to a first input 12 of a processing unit 14, the output 15 of which is connected to electronic injection system 4.

On the basis of the pressure (P) and temperature (T) of the air in the intake manifold, unit 10 calculates (e.g. via the ideal gas law) the air intake (Q) of engine 6, which value (Q) is subsequently used for calculating a quantity proportional to the amount of fuel ($Q_b$) required by engine 6 for achieving a correct air/fuel ratio.

For this purpose, using memorized tables or at any rate in known manner, unit 10 determines a theoretical fuel quantity ($Q_b$) as a function of the air intake (Q) and speed (n) of the engine, which value ($Q_b$) is purely a rough estimate of the optimum value, which is subsequently corrected as described in detail later on.

Unit 14 presents a second input 16 connected to the output 17 of a proportional-integral controller 18, the input 19 of which is supplied with a signal (E) from a node 20.

Node 20 is supplied with three signals: a signal ($V_{lambda}$) generated by a sensor 21 inside the exhaust manifold of engine 6; a constant sign-inverted reference signal ($V_{st}$); and a correction signal described in detail later on.

Controller 18 calculates a correction variable $K_{02}$ on the basis of the signal (E) at input 19 and according to the equation:

$$K_{02}=Ki^*\int(E)dt+Kp^*(E)$$

where Ki and Kp are constants.

On the basis of the signals at its inputs, processing unit 14 calculates a correct fuel quantity $Q_{bc}$ according to the equation:

$$Q_{bc}=Qb^*(l+K_{02})$$

where $Q_b$ is the theoretical fuel quantity calculated by unit 10; and $K_{02}$ the correction variable calculated by controller 18.

System 1 also comprises a predictor 26 having an input 30 connected to output 17, and an output 32 connected to node 20.

Predictor 26 comprises a circuit 37 connected to input 30 and sensor 21, and the output 40 of which is connected to input 43 of a simulating unit 45 comprising three cascade-connected blocks 50, 53 and 57.

Output 60 of simulating unit 45 is connected directly to the adding input of a node 65, and to the input of a delay circuit 70, the output of which is sign-inverted and connected to node 65 in turn connected to output 32.

Circuit 37 is supplied with the correction parameter ($K_{02}$) value and the $V_{lambda}$ signal generated by sensor 21, and in turn supplies an output signal estimating the value of the fuel/air ratio of engine 6.

Unit 45 simulates the transfer function of the engine-sensor system minus the delay (T) introduced by sensor 21 and by the time taken for the gas to reach the exhaust manifold. Blocks 50, 53 and 57 in fact reproduce the transfer functions by respectively simulating combustion inside the combustion chamber of engine 6; the mixing effects inside the exhaust manifold; and response of sensor 21. Blocks 53 and 50 conveniently consist of low-pass filters.

For calculating the fuel/air ratio, circuit 37 presents a memory 38 (circular buffer type) containing $K_{02}$ parameter values calculated for each top dead center (TDC) position of engine 6.

Circuit 37 estimates the fuel/air ratio at the time sensor 21 switches, by adding to the unit the difference between the current value of parameter $K_{02}$ and the value of $K_{02}$ prior to a time interval equal to the delay (T) introduced by the system.

Figure 2:
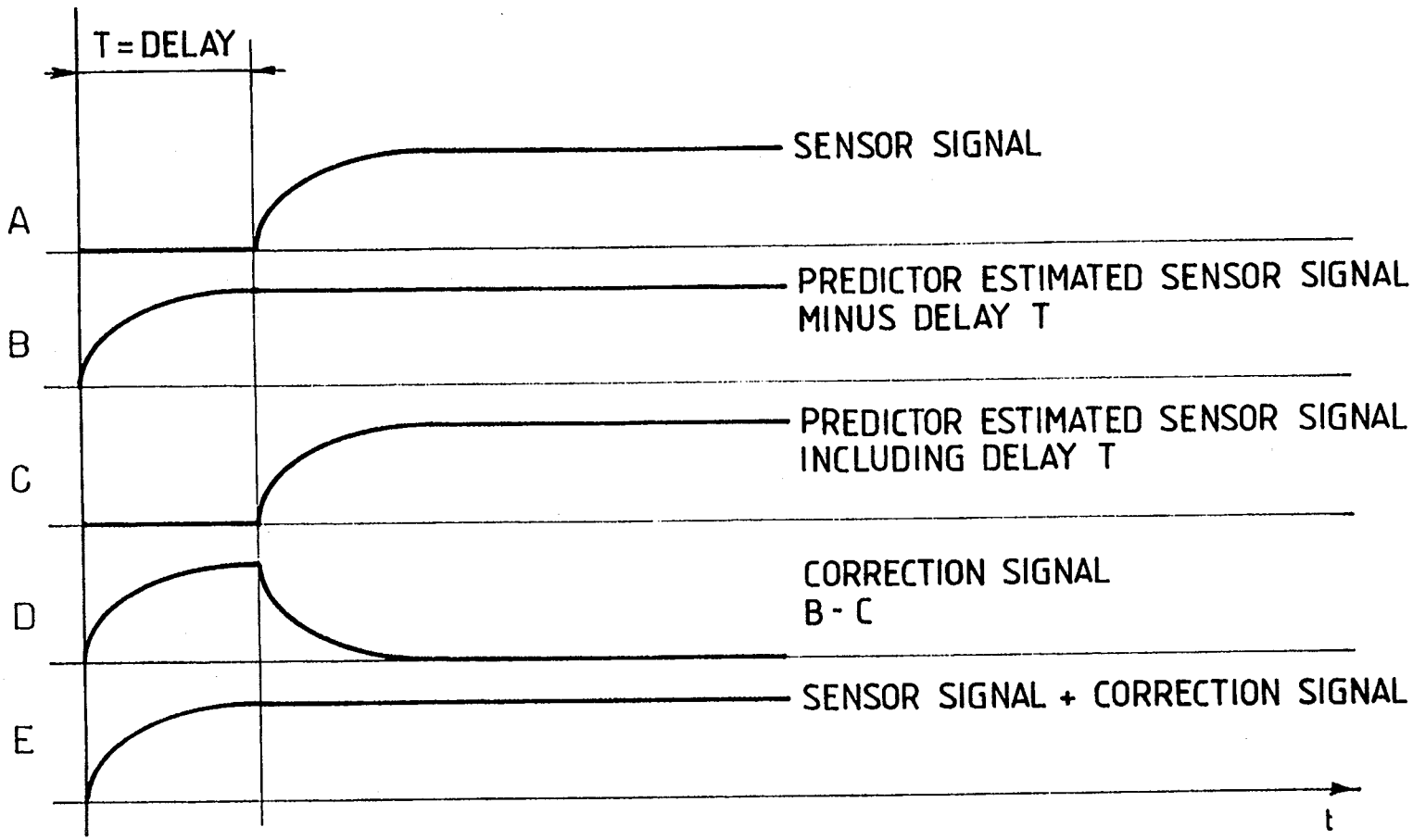
FIG. 2 shows time graphs of a number of signals on the control system.

Operation of the system will now be described with reference to FIG. 2, which shows time graphs of five signals A, B, C, D, E, respectively representing the signal generated by sensor 21; the signal estimated by simulating unit 45 and present at output 60; the signal at the output of delay circuit 70; the correction signal at output 32 (equal to the difference between signals B and C); and the correct signal present at input 19 in the event of a zero constant reference signal ($V_{st}$).

In response to a departure of the air/fuel mixture from the stoichiometric value, sensor 21 switches, for example, from a low voltage level (close to 0 V) to a high voltage level (close to 1 V). This occurs (signal A) after a time interval (T) mainly due to the time taken by the air/fuel mixture to undergo combustion, by the burnt gases to reach the exhaust manifold, and to the response time of sensor 21 itself.

As unit 45 simulates what actually occurs in engine 6 as regards departure of the fuel/air ratio from the stoichiometric ratio, the signal at output 60 (signal B) presents substantially the same form as the signal (A) generated by sensor 21, minus the delay (T) introduced by the system, whereas the signal at the output of circuit 70 (signal C) presents substantially the same form as the signal (A) generated by sensor 21, including the delay (T).

Signal D, equal to the difference between signals C and B estimated respectively with and without delay T, thus represents the correction required by the real signal (A) for compensating the delay.

The correction signal (D) is therefore added to the real signal (A) generated by sensor 21 to give a correct signal (E) substantially equal to that which would be generated by sensor 21 in the absence of system delay T, which is thus corrected for improving the dynamic response of system 1 as a whole.

More specifically, the above improvement in response also provides for improving other system parameters, such as the efficiency of proportional-integral controller 18 (FIG. 3*a*), the integral factor of which may be increased for accelerating system response to a departure from the stoichiometric ratio, with no risk of deviating excessively from the correct value (increase in the slope of the linear increase portions) as on known systems. Moreover, the proportional factor of the controller may be reduced for reducing the oscillating range of the air/fuel ratio about the stoichiometric ratio.

Figure 3A:
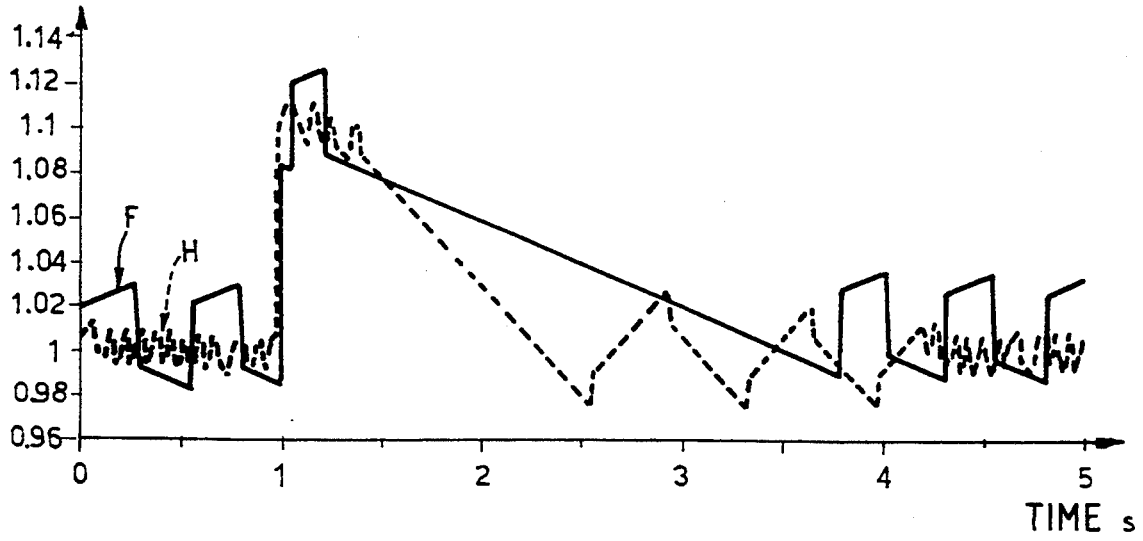
FIGS. 3*a* and 3*b* show experimental time graphs of a number of quantities on the FIG. 1 system.
Figure 3B:
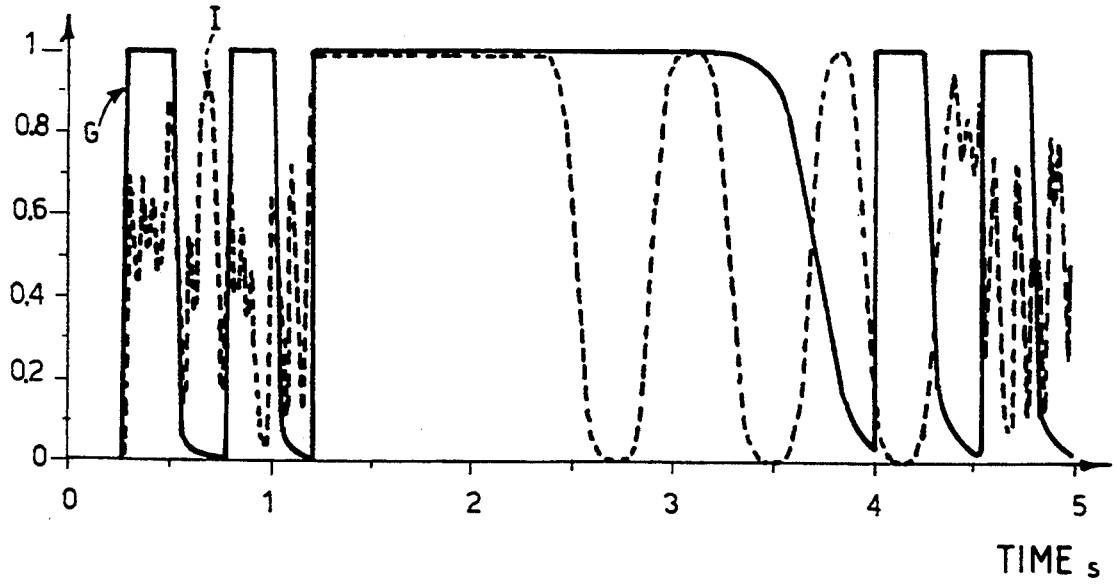

The advantages obtainable can be seen in FIGS. 3*a* and 3*b*, which respectively show the air/fuel ratio values and the signal generated by sensor 21 as a function of time.

F and G in FIGS. 3*a* and 3*b* indicate the signals obtainable using a conventional system, and H and I those obtained in laboratory tests of the system according to the present invention.

To those skilled in the art it will be clear that changes may be made to the system as described and illustrated herein without, however, departing from the scope of the present invention.

For example, the fuel/air ratio value may be estimated by circuit 37 via statistical analysis, e.g. using a Kalman filter or a status estimator.

Also, block 10 may be designed differently and supplied with the speed (n) of engine 6 and an air supply signal (Q) from a gauge (not shown) inside the intake manifold, which signal (Q) may be corrected by means of two signals respectively proportional to the pressure (P) and temperature (T) of the air in the intake manifold, for obtaining a correct air supply signal ($Q_c$) with which to calculate the theoretical fuel quantity ($Q_b$).

We claim:

1. An internal combustion engine having an electronic fuel injection system comprising:

first processing means for determining a theoretical fuel quantity as a function of information signals;

second processing means for determining a correcting parameter;

a sensor arranged inside the exhaust manifold of said engine;

said sensor generating a sensing signal representing a transfer function comprising at least a nonlinear characteristic and a time delay;

predicting means receiving at least the value of said correcting parameter and generating a correction signal;

said predicting means at least comprising means for generating a prediction signal simulating said sensing signal minus said time delay;

adding means for adding said prediction signal to said sensing signal, said adding means including means for generating a summation signal;

said second processing means calculating said correcting parameter for correcting said theoretical quantity as a function of said summation signal;

third processing means for calculating a correct fuel quantity as a function of said correcting parameter and having means for generating a fuel signal to the injection system representing the correct fuel quantity.

2. The internal combustion engine of claim 1 wherein said first processing means determines said theoretical fuel quantity on the basis of memorized tables.

3. The internal combustion engine of claim 1 wherein said first processing means determines said theoretical fuel quantity on the basis of air supply to the intake manifold of said engine and engine speed.

4. The internal combustion engine of claim 1 wherein said second processing means comprises means for calculating said correcting parameter by integrating said sensing signal.

5. The internal combustion engine of claim 1 wherein said predicting means comprises fourth processing means, the input of which is supplied with the value of said correcting parameter, and the output of which supplies an estimate signal as a function of the estimated fuel/air ratio; said predicting means also comprising fifth processing means for simulating said transfer function minus said time delay; said fifth processing means being supplied with said estimate signal and generating said prediction signal.

6. The internal combustion engine of claim 5 wherein said fourth processing means comprises storage means containing values of said correcting parameter calculated at predetermined instants in the operating cycle of said engine; said fourth processing means also comprising interpolating means for adding to said storage means, at each switch operation of said sensor, the difference between a first value of said correcting parameter and a second previously measured value of said correcting parameter, for estimating said fuel/air ratio.

7. The internal combustion engine of claim 5 wherein said predicting means comprises delay means for simulating said time delay; said delay means being connected to said fifth processing means for generating a delayed signal; said predicting means also comprising second adding means connected to said delay means and to said fifth processing means, for subtracting said delayed signal from said prediction signal and so generating said fuel signal.

8. The internal combustion of claim 7 wherein said fifth processing means comprises sixth, seventh, and eighth cascade-connected processing means for reproducing said transfer function by respectively simulating the combustion inside the combustion chamber of said engine, the mixing effects inside the exhaust manifold, and said nonlinear characteristic of said sensor.

9. The internal combustion engine of claim 8 wherein said sixth and seventh means comprise at least a low-pass filter.

10. A method of calculating an injection time for an electronic fuel injection system of an internal combustion engine comprising the steps of:

determining a theoretical fuel quantity as a function of information signals;

receiving a sensing signal generated by a sensor arranged inside the exhaust manifold of said engine;

said sensing signal representing a transfer function comprising at least a nonlinear characteristic and a time delay;

generating a correction signal on the basis of at least the value of a correcting parameter;

the step of generating a correction signal comprising generating a prediction signal simulating said sensing signal minus said time delay;

adding said prediction signal to said sensing signal to obtain a summation signal;

calculating said correcting parameter for correcting said theoretical quantity as a function of said summation signal;

calculating a correct fuel quantity as a function of said correcting parameter.

11. The method of claim 10 wherein the step of determining said theoretical fuel quantity calculates said theoretical fuel quantity on the basis of memorized tables.

12. The method of claim 10 wherein the step of determining said theoretical fuel quantity calculates aid theoretical fuel quantity on the basis of air supply to the intake manifold of said engine and engine speed.

13. The method of claim 10 wherein the step of calculating said correcting parameter calculates said correcting parameter by integrating said sensing signal.

14. The method of claim 10 wherein the step of generating a correction signal includes utilizing said correcting parameter to generate an estimated signal as a function of the estimated fuel/air ratio; and simulating the transfer function of said sensing signal minus said time delay in combination with said estimated signal to generate said prediction signal.

15. The method of claim 14 wherein the step of generating a correction signal utilizes storage which contains values of said correcting parameter calculated at predetermined instants in the operating cycle of said engine; and said correction signal generating step includes interpolating the value of said correcting parameters, at each switch operation of said sensor, by calculating the difference between a first value of said correcting parameter and a second previously measured value of said correcting parameter for estimating said fuel/air ratio.

16. The method of claim 14 wherein the step of generating a correction signal includes simulating said time delay and generating a delayed signal; and subtracting said delayed signal from said prediction signal and so generating said correction signal.

17. The method of claim 16 wherein the step of generating a correction signal includes reproducing the transfer function by simulating the combustion inside the combustion chamber of said engine, the mixing effects inside the exhaust manifold, and said nonlinear characteristic of said sensing signal.

18. The method of claim 17 wherein the step of reproducing utilizes at least a low-pass filter.

* * * * *

UNITED STATES PATENT AND TRADEMARK OFFICE

CERTIFICATE OF CORRECTION

PATENT NO. : 5,335,643

DATED : August 9, 1994

INVENTOR(S) : Abate et al

It is certified that error appears in the above-indentified patent and that said Letters Patent is hereby corrected as shown below:

On the Title page, item [30], "Foreign Application Priority Data" delete "00976 A/91" and insert therefor --T091A000976--.

Signed and Sealed this

Second Day of May, 1995

Bruce Lehman

*Attest:*

BRUCE LEHMAN

*Attesting Officer*

*Commissioner of Patents and Trademarks*